US008727955B2

(12) United States Patent
Huang

(10) Patent No.: US 8,727,955 B2
(45) Date of Patent: May 20, 2014

(54) ABDOMINAL EXERCISE DEVICE HAVING FIGURE SHAPING FUNCTION

(76) Inventor: Wendy Huang, New Taipei (TW)

( * ) Notice: Subject to any disclaimer, the term of this patent is extended or adjusted under 35 U.S.C. 154(b) by 208 days.

(21) Appl. No.: 13/450,556

(22) Filed: Apr. 19, 2012

(65) Prior Publication Data

US 2013/0109546 A1 May 2, 2013

(30) Foreign Application Priority Data

Nov. 1, 2011 (TW) ..... 100220598 U

(51) Int. Cl.
*A63B 21/015* (2006.01)
*A63B 19/00* (2006.01)

(52) U.S. Cl.
USPC ..... 482/115; 482/124; 601/132

(58) Field of Classification Search
CPC .... A63B 21/015; A63B 19/00; A63B 21/018; A63B 23/02
USPC ..... 482/115, 114, 10–11, 44–50, 79, 482/91–92, 121–126, 131–132, 139, 148; 601/84, 97, 112, 113, 118–125, 128, 601/129, 143, 147, 131–137
See application file for complete search history.

(56) References Cited

U.S. PATENT DOCUMENTS

| | | | | | |
|---|---|---|---|---|---|
| 3,957,039 | A * | 5/1976 | Ehren | ..... | 601/132 |
| 5,690,595 | A * | 11/1997 | Quinones | ..... | 482/124 |
| 6,056,621 | A * | 5/2000 | Lin | ..... | 446/236 |
| 6,109,999 | A * | 8/2000 | Kuo | ..... | 446/236 |
| 6,379,288 | B1 * | 4/2002 | Liu | ..... | 482/105 |
| 2008/0108484 | A1 * | 5/2008 | Wu et al. | ..... | 482/122 |
| 2010/0279830 | A1 * | 11/2010 | Snagg | ..... | 482/124 |

* cited by examiner

*Primary Examiner* — Loan H Thanh
*Assistant Examiner* — Megan Anderson
(74) *Attorney, Agent, or Firm* — Fitzpatrick, Cella, Harper & Scinto

(57) ABSTRACT

An abdominal exercise device includes two operating mechanisms and two connecting mechanisms. Each of the operating mechanisms includes an outer housing, a grip disposed at an end of the outer housing, and a rolling unit disposed at an opposite end of the outer housing. The rolling units of the operating mechanisms contact respectively two sides of the waist or hip of a user. The connecting mechanisms cooperate with the operating mechanisms to form a looped structure. Each of the connecting mechanisms includes an elastic connecting piece connected between the outer housings of the operating mechanisms, and a plurality of sliding units sleeved movably on the elastic connecting piece and movable upwardly and downwardly on the abdomen or back of the user.

11 Claims, 14 Drawing Sheets

ABDOMINAL EXERCISE DEVICE HAVING FIGURE SHAPING FUNCTION

CROSS-REFERENCE TO RELATED APPLICATION

This application claims priority of Taiwanese Application No. 100220598, filed on Nov. 1, 2011.

BACKGROUND OF THE INVENTION

1. Field of the Invention

This invention relates to an exerciser, and more particularly to an abdominal exercise device having figure shaping function.

2. Description of the Related Art

Abdominal exercise devices (e.g., disclosed in US20040002413 and U.S. Pat. No. 7,604,581) are provided for exercising and massaging the user's abdominal muscles. This invention is another approach to such an abdominal exercise device.

SUMMARY OF THE INVENTION

The object of this invention is to provide an abdominal exercise device that can exercise and massage the user's abdominal muscles so as to have figure shaping function.

According to this invention, an abdominal exercise device includes two operating mechanisms and two connecting mechanisms.

Each of the operating mechanisms includes an outer housing, a grip disposed at an end of the outer housing, and a rolling unit disposed at an opposite end of the outer housing. The rolling units of the operating mechanisms contact respectively two opposite sides of a waist or a hip of a user. The grips of the operating mechanisms are held respectively by the hands of the user. The connecting mechanisms cooperate with the operating mechanisms to form a looped structure. Each of the connecting mechanisms includes an elastic connecting piece connected between the outer housings of the operating mechanisms, and a plurality of sliding units sleeved movably on the elastic connecting piece and movable upwardly and downwardly on one of the abdomen or back of the user.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
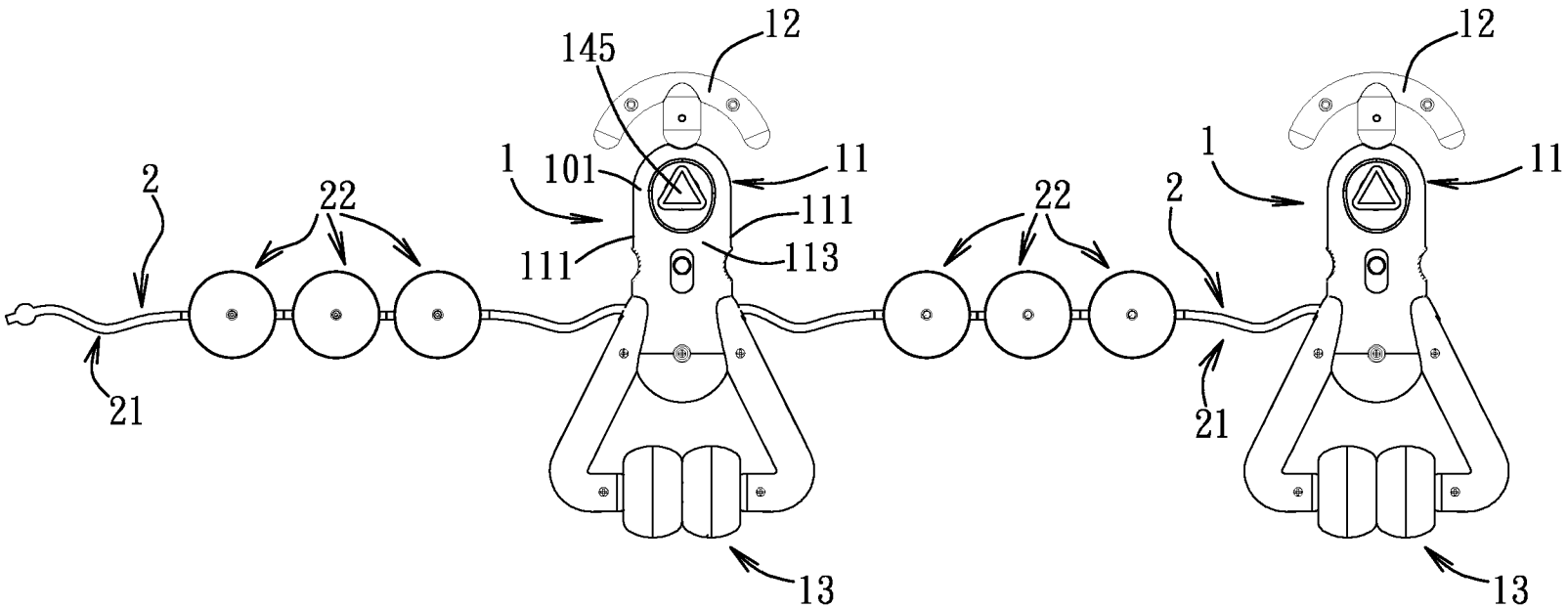
FIG. 1 is a perspective view of the preferred embodiment of an abdominal exercise device according to this invention.
Figure 2:
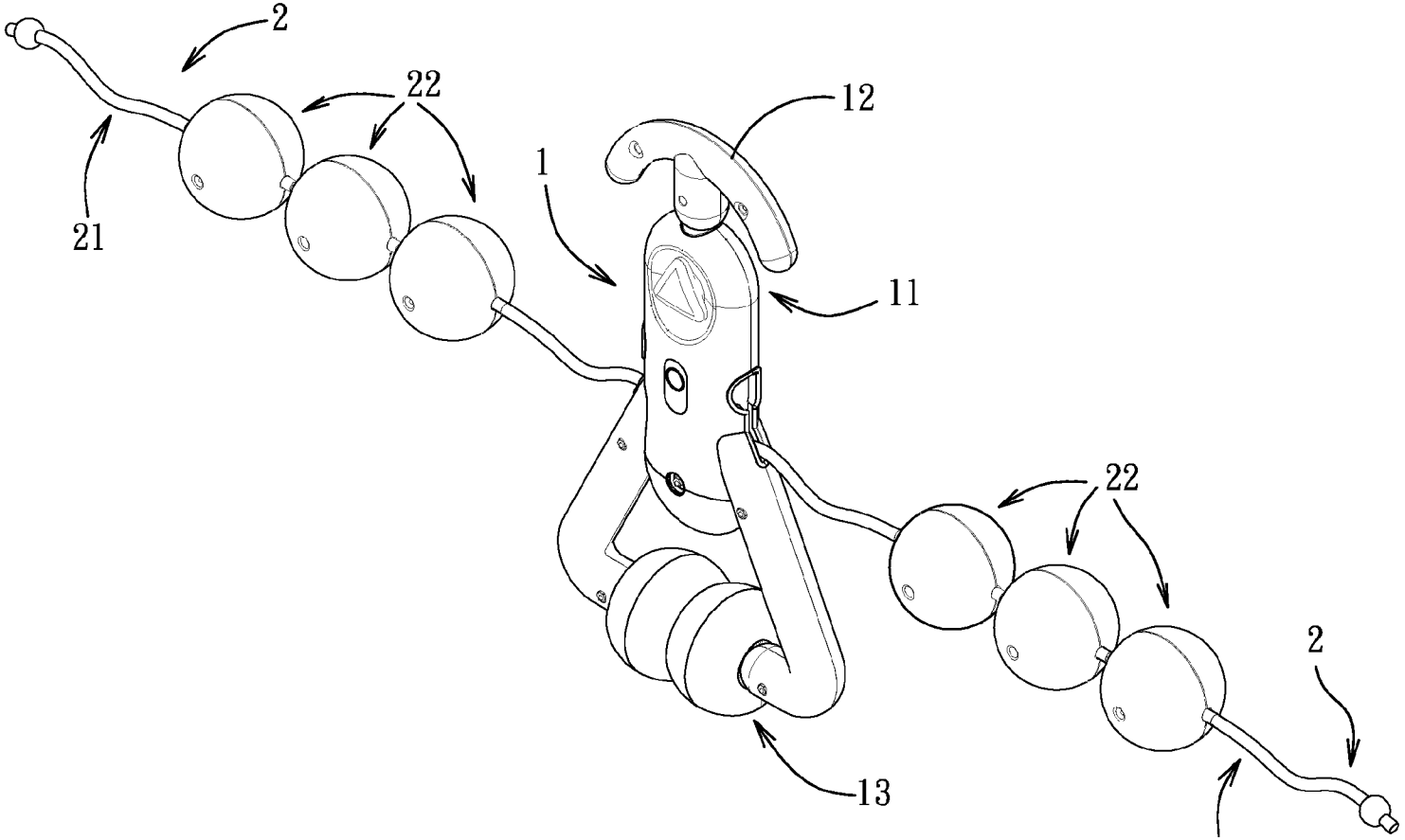
FIG. 2 is a perspective view of an operating mechanism of the preferred embodiment.

Referring to FIGS. 1, 2, 3, and 9, the preferred embodiment of an abdominal exercise device according to this invention can be operated by two hands of a user 3 to excise and massage the muscles of his or her abdomen, waist, back, and hip to thereby have figure shaping effect. The abdominal exercise device includes two operating mechanisms 1 (only one is shown in FIG. 2) and two connecting mechanisms 2.

Figure 4:
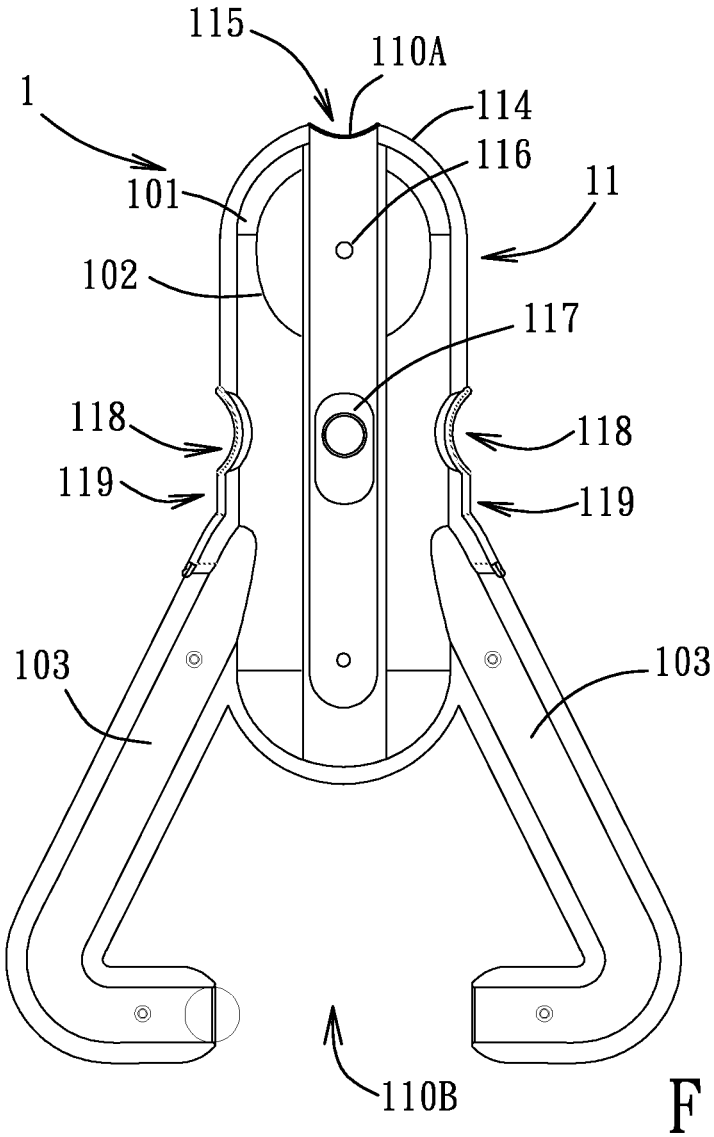
FIG. 4 is a side view of an outer housing of the preferred embodiment.

With additional reference to FIG. 4, each of the operating mechanisms 1 includes an outer housing 11 having opposite first and second ends 110A, 110B, a grip 12 disposed at the first end 110A of the outer housing 11, and a rolling unit 13 disposed at the second end 110B of the outer housing 11.

Each of the outer housings 11 includes two hollow halves 101. Each of the hollow halves 101 includes an elongated elliptical main body 102 having two opposite first sidewalls 111, and two channel bar portions 103 extending respectively from the first sidewalls 111 away from each other. Each of the channel bar portions 103 has an inclined section 103A inclined relative to a longitudinal direction of the corresponding elliptical main body 102, and a transverse bar section 103B perpendicular to the longitudinal direction of the corresponding elliptical main body 102 and having an end connected to an end of the inclined section 103A. The inclined sections 103A of each of the hollow halves 101 extend respectively from the two opposite first sidewalls 111 away from each other. The transverse bar sections 103B of each of the hollow halves 101 extend respectively from the inclined sections 103A of the corresponding hollow half 101 toward each other.

The elongated elliptical main body 102 of each of the outer housings 11 further has two opposite second sidewalls 113, 114 connected between the first sidewalls 111, an insert groove 115 extending from the first end 110A toward the second end 110B, and two aligned through holes 116 formed respectively through the second sidewalls 113, 114 and aligned with the insert groove 115.

Figure 5:
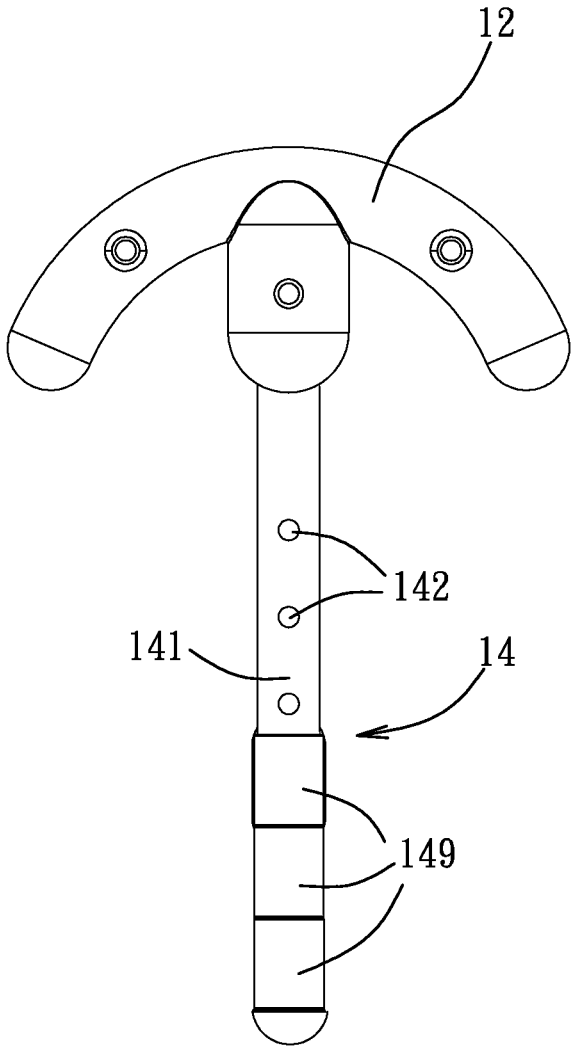
FIG. 5 is a side view of a grip and an adjusting unit of the preferred embodiment.
Figure 6:
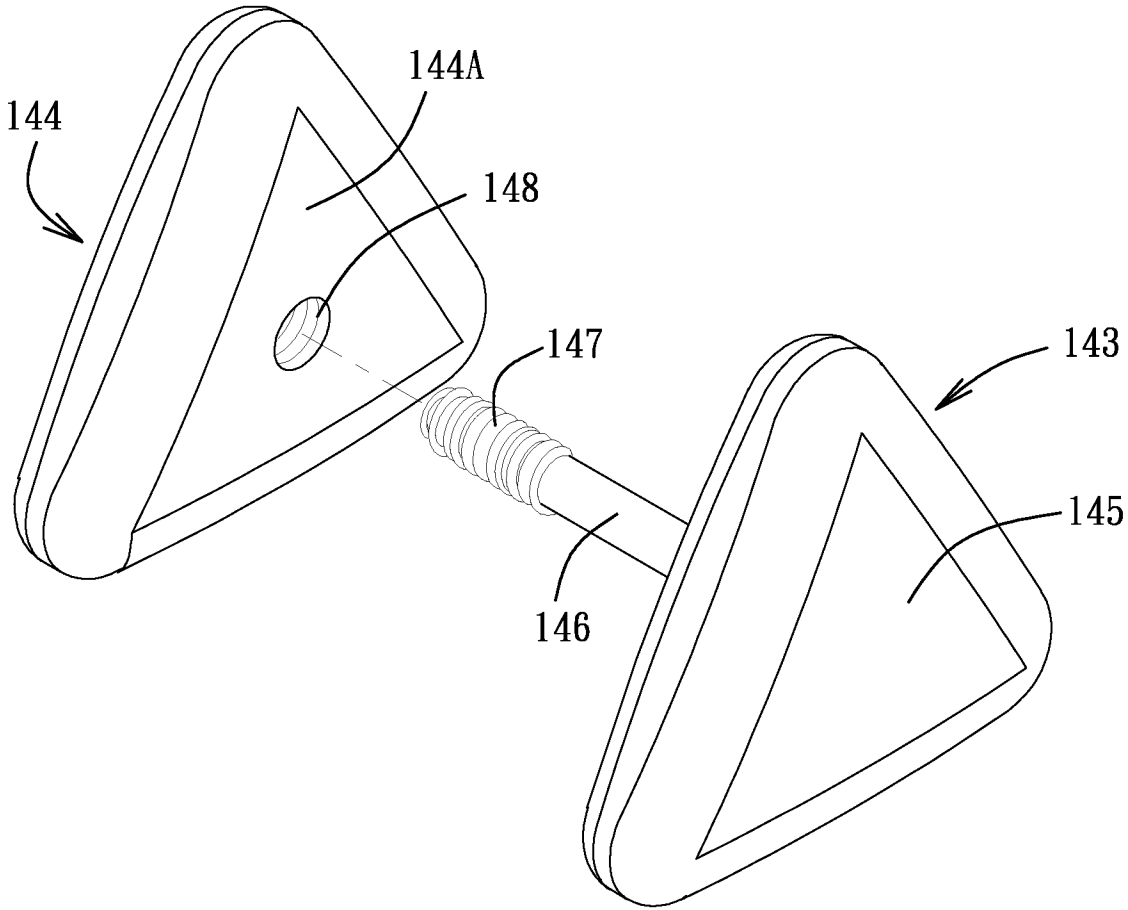
FIG. 6 is an exploded perspective view of a lock bolt unit of the preferred embodiment.

With further reference to FIGS. 5 and 6, each of the operating mechanisms 1 further includes an adjustment unit 14. The adjustment unit 14 of each of the operating mechanisms 1 includes an adjusting rod 141 inserted movably into the insert groove 115 in the corresponding outer housing 11 and formed with a plurality of positioning holes 142 arranged along a longitudinal direction of the adjusting rod 141, and a lock bolt unit extending through the through holes 116 in the second sidewalls 111 and a selected one of the positioning holes 142 in the adjusting rod 141 for locking the adjusting rod 141 relative to the corresponding outer housing 11. The lock bolt unit of each of the adjustment units 14 includes: a bolt 143 having a plate-shaped head 145 abutting against the corresponding second sidewall 113 (see FIG. 1), and a stem 146 extending from the head 145 and having an externally threaded end 147; and a nut 144 having a plate-shaped main body 144A abutting against the corresponding second sidewall 114, and a threaded hole 148 formed in the plate-shaped main body 144A and engaging the externally threaded end 147 of the bolt 143. The adjusting rod 141 of each of the operating mechanisms 1 is connected fixedly to the corresponding grip 12 at an end thereof.

Each of the adjustment units 14 further includes a plurality of colored rings 149 sleeved on the adjusting rod 141 and having different colors. In this embodiment, the number of the colored rings 149 is three. Any two adjacent ones of the colored rings 149 abut against each other. Each of the second sidewalls 113, 114 of each of the outer housings 11 is formed with a window 117, through which one of the colored rings 149 is visible.

Figure 3:
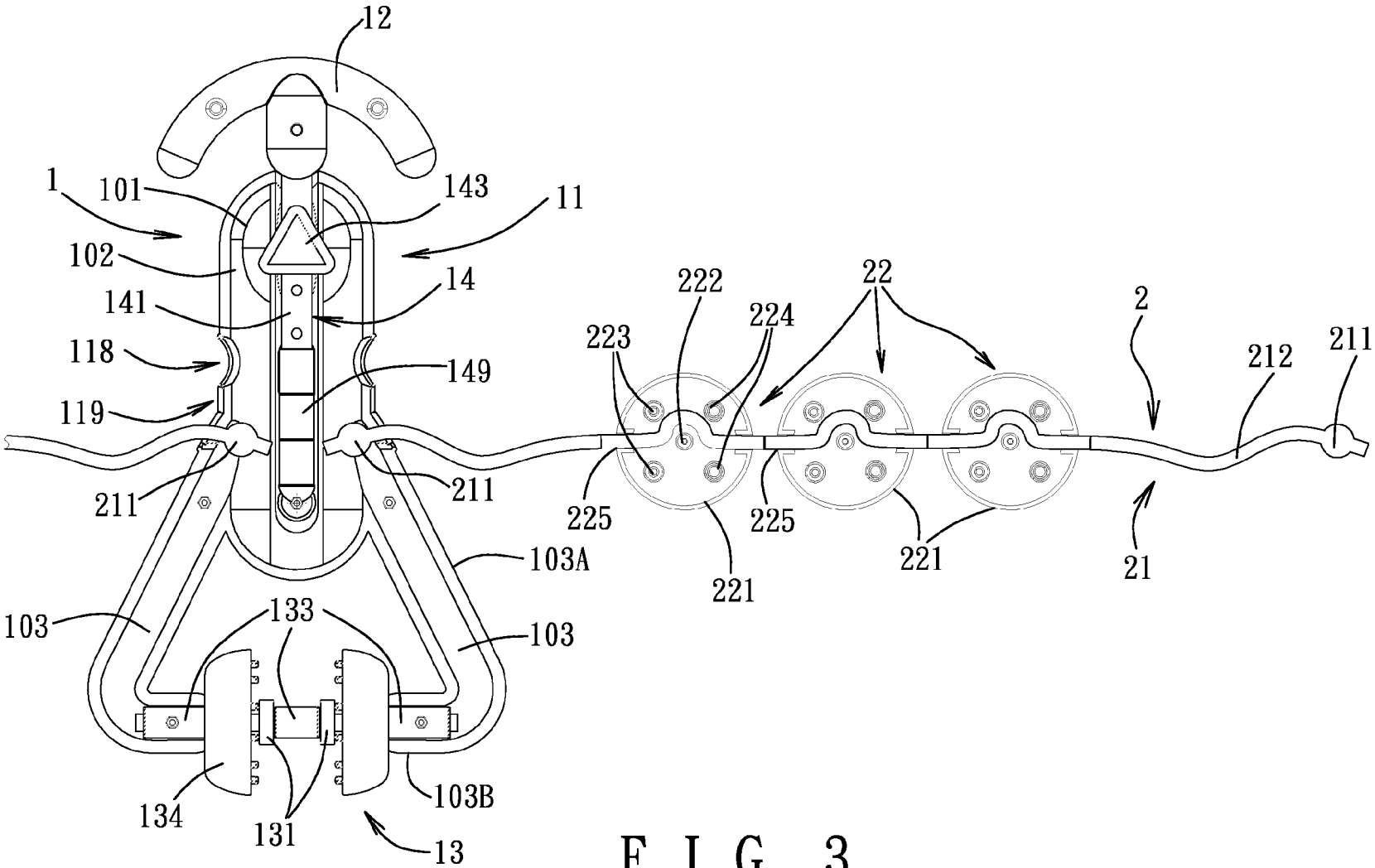
FIG. 3 is a fragmentary schematic view of the preferred embodiment, portions of two position-limiting pieces being removed for the sake of brevity.
Figure 7:
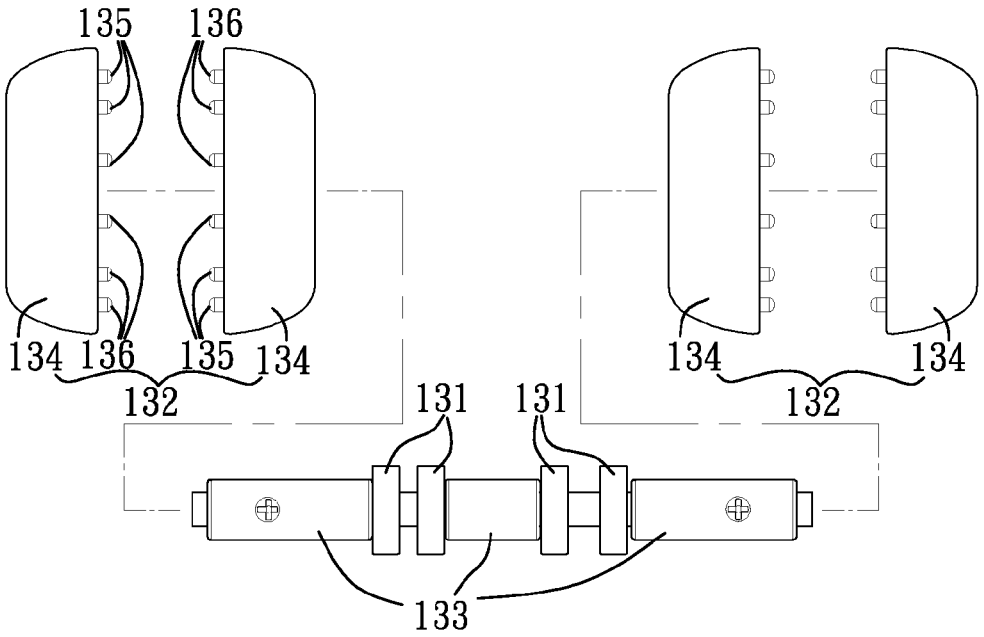
FIG. 7 is an exploded side view of a rolling unit of the preferred embodiment.
Figure 8:
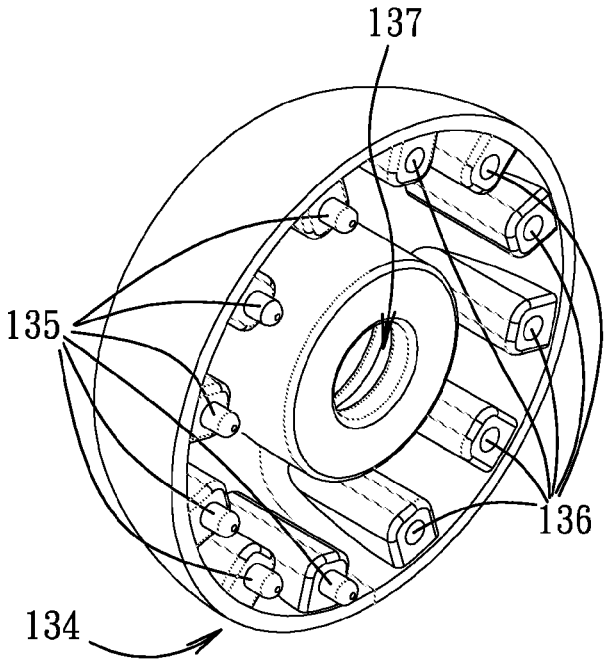
FIG. 8 is a perspective view of a half of a rolling piece of the preferred embodiment.

With particular reference to FIGS. 3, 7, and 8, each of the rolling units 13 includes at least one pair of ball bearings 131, and at least one rolling piece 132 sleeved on the ball bearings 131. The pair number of the ball bearings 131 corresponds to the number of the rolling piece 132. In this embodiment, each of the rolling units 13 includes two pairs of ball bearings 131 and two rolling pieces 132, and further includes a plurality of position-limiting pieces 133. Each pair of ball bearings 131 is confined between two adjacent ones of the position-limiting pieces 133 for preventing movement of the ball bearings 131 relative to the corresponding outer housing 11. Each of the rolling units 13 is confined between the channel bar portions 103 of the corresponding outer housing 11, in such a manner that two of the position-limiting pieces 133 are secured respectively within the transverse bar sections 103B of the corresponding hollow half 101. Each of the rolling pieces 132 includes a first half 134 and a second half 134, each of which is formed with a plurality of tongues 135, a plurality of grooves 136, and a central hole 137 formed therethrough and permitting the corresponding ball bearing 131 to be disposed therein. The tongues 135 of the first half 134 engage respectively the grooves 136 of the second half 134. The grooves 136 of the first half 134 engage respectively the tongues 135 of the second half 134.

With particular reference to FIGS. 1, 3, and 4, each of the connecting mechanisms 2 is connected between the operating mechanisms 1, such that the connecting mechanisms 2 cooperate with the operating mechanisms 1 to form a looped structure. Each of the connecting mechanisms 2 includes an elastic connecting piece 21 extending from one of the first sidewalls 111 of one of the outer housings 11 into an adjacent one of the first sidewalls 111 of the other of the outer housings 11, and a plurality of sliding units 22 sleeved movably on the elastic connecting piece 21. In this embodiment, each of the elastic connecting pieces 21 extends through three sliding units 22.

Each of the elastic connecting pieces 21 has two enlarged ends 211 and a rope body 212 connected between the enlarged ends 211 and permitting the corresponding sliding units 22 to be sleeved thereon. In this embodiment, the rope body 212 is a rubber hose, and each of the enlarged ends 211 are formed by inserting a ball (not shown) into the rope body 212.

Figure 4A:
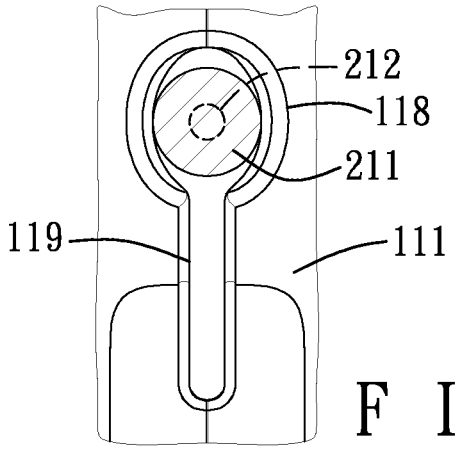
FIG. 4A is a schematic view illustrating a wide opening portion and a narrow opening portion of an opening in the outer housing of the preferred embodiment.

With particular reference to FIGS. 3 and 4A, each of the first sidewalls 111 of the outer housings 11 is formed with an opening having a wide opening portion 118 having a width slightly greater than the diameter of the corresponding enlarged end 211 of the corresponding elastic connecting piece 21 so as to allow the corresponding enlarged end 211 to move therethrough, and a narrow opening portion 119 connected to the wide opening portion 118 and having a width smaller than the diameter of the corresponding enlarged end 211 and slightly greater than the diameter of the corresponding rope body 212, so as to prevent movement of the corresponding enlarged end 211 therethrough, while allowing for extension of the corresponding rope body 212 therethrough.

With particular reference to FIG. 3, each of the sliding units 22 includes a hollow first half 221, a hollow second half 221, and a central rod 222 connected between the centers of the first and second halves 221. Each of the first and second halves 221 is formed with a plurality of tongues 223 and a plurality of grooves 224. The tongues 223 of the first half 221 engage respectively the grooves 224 of the second half 221. The grooves 224 of the first half 221 engage respectively the tongues 223 of the second half 221. An assembly of the first and second halves 221 is formed with two apertures 225 aligned with the central rod 222 and located respectively at two sides of the central rod 222.

The rope body 212 of each of the elastic connecting pieces 21 extends through the apertures 225 in the corresponding sliding unit 22 and around the central rod 222 of the corresponding sliding unit 22.

Figure 9:
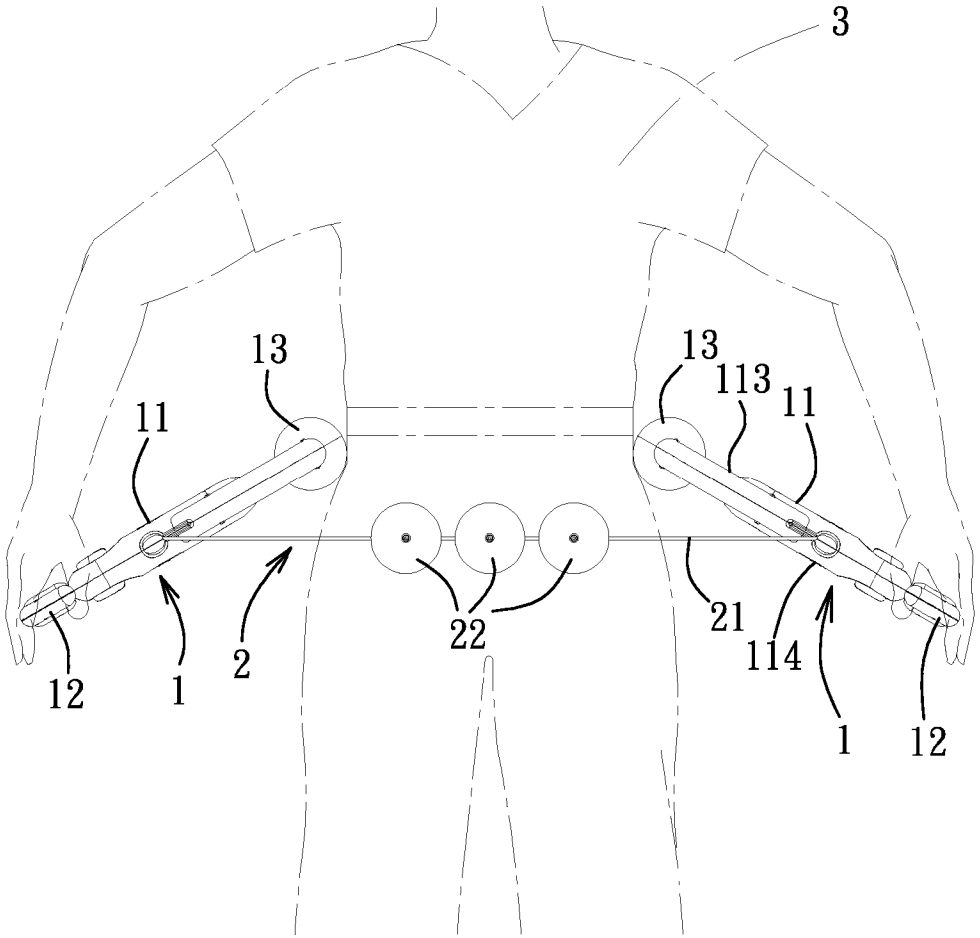
FIGS. 9 to 15 are schematic views illustrating various manners, in which the preferred embodiment can be operated.

With particular reference to FIGS. 3 and 9, when the user 3 desires to use the abdominal exercise device, the operating mechanisms 1 are connected to the connecting mechanisms 2 by moving the enlarged ends 211 of the elastic connecting pieces 21 respectively through the wide opening portions 118 and subsequently moving the rope bodies 212 into ends of the narrow opening portions 119 distal from the wide opening portions 118, in such a manner that the body of the user 3 is surrounded by an a looped assembly of the operating mechanisms 1 and the connecting mechanisms 2.

During use of the abdominal exercise device, the user 3 holds the grips 12 with his hands, and moves the rolling units 13 and the sliding units 22 on his body in such a manner to press the same against his body.

The abdominal exercise device can be used in various manners, e.g., in the following manners.

Figure 10:
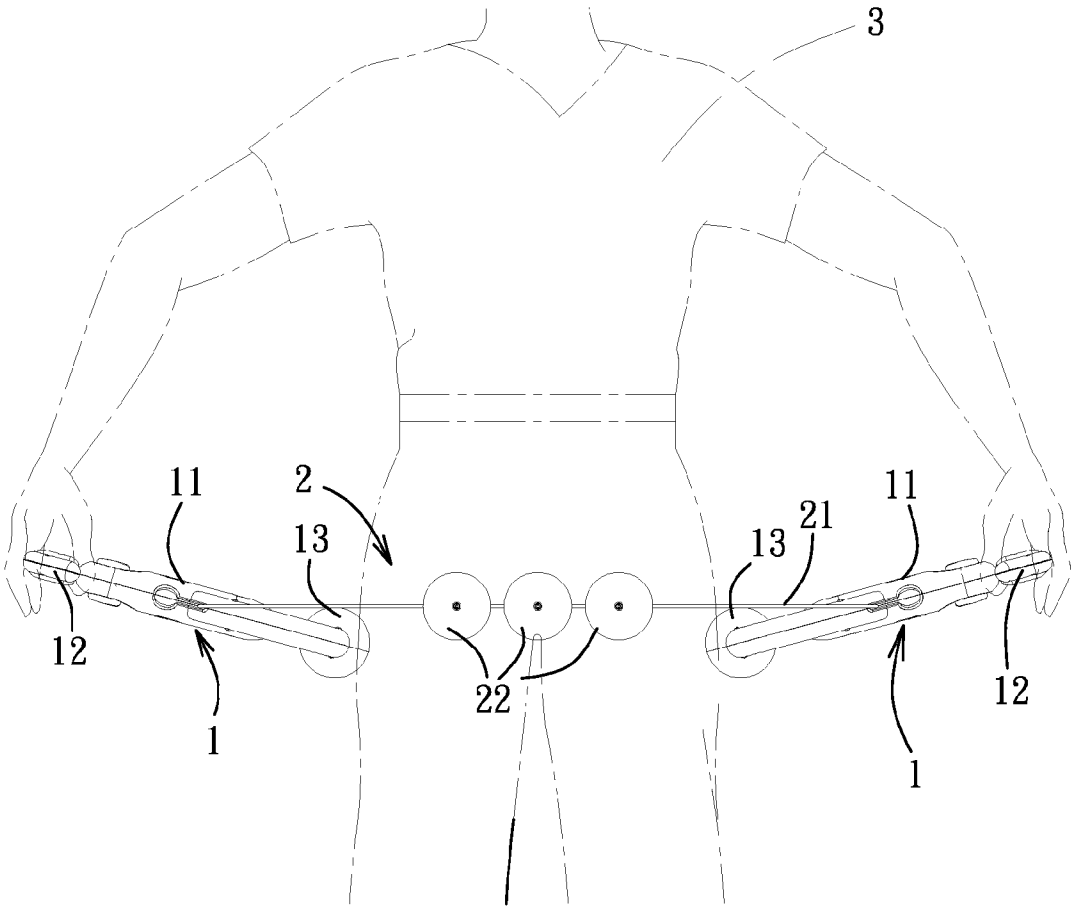
Figure 11:
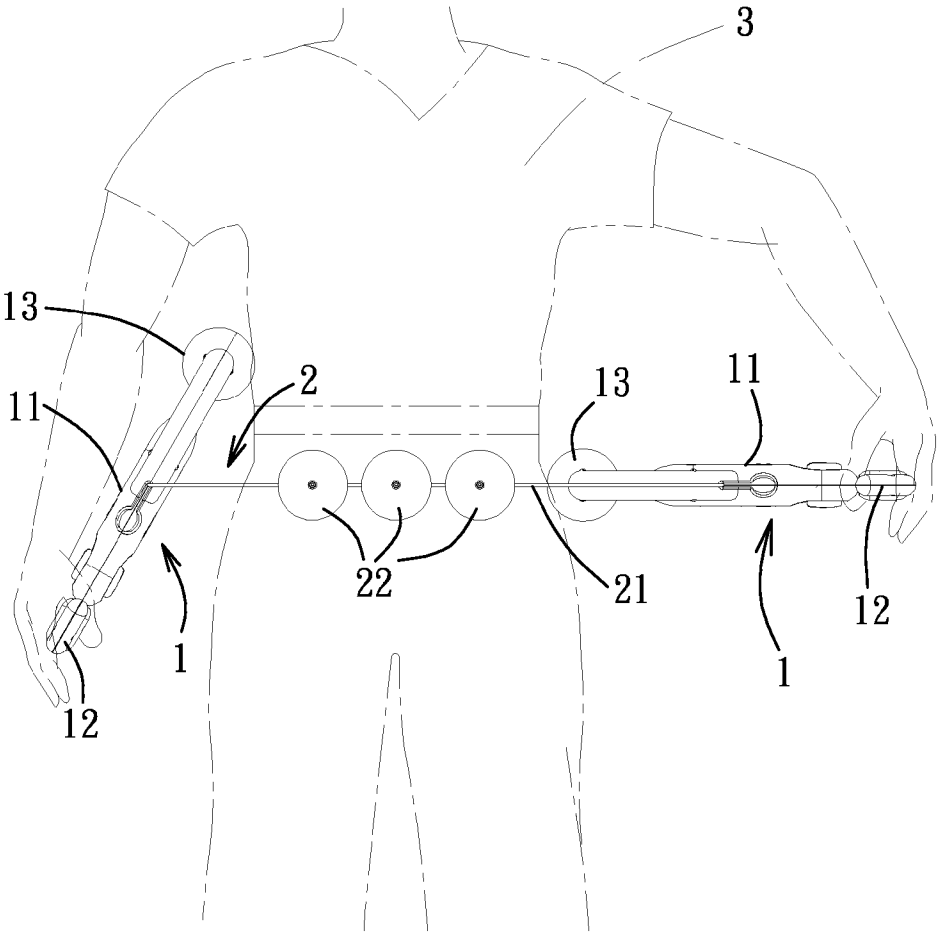
Figure 12:
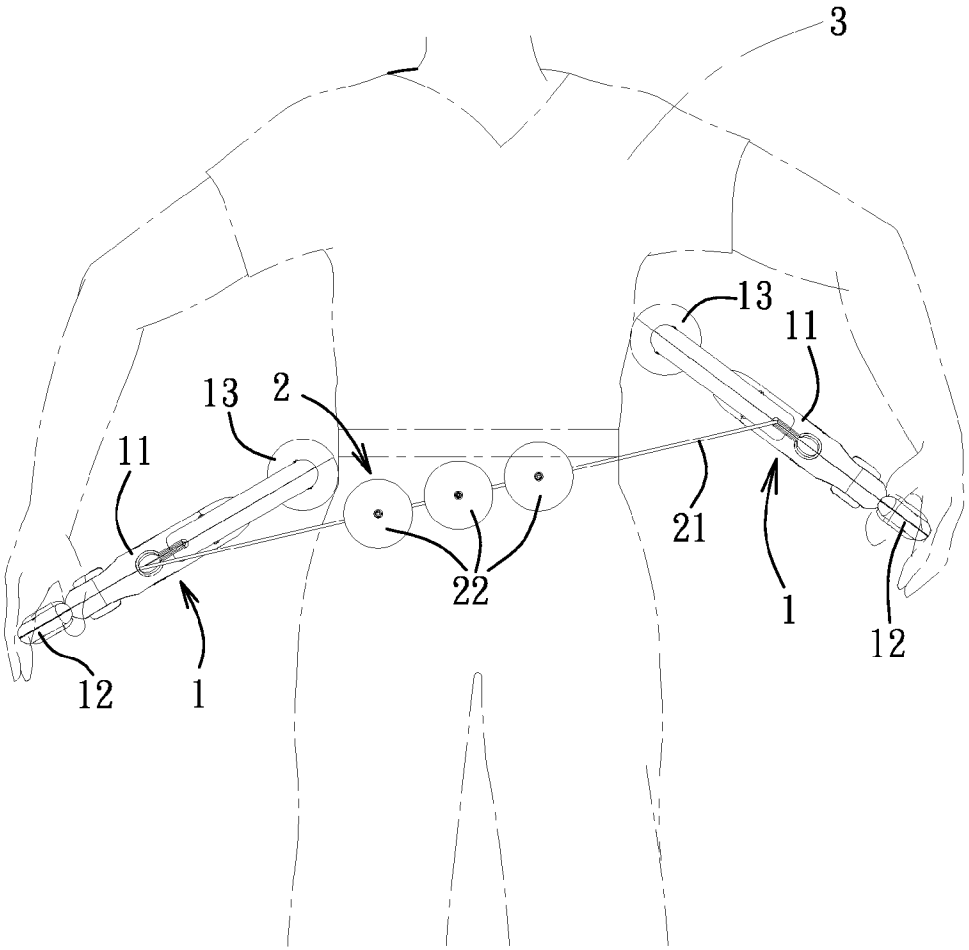
Figure 13:
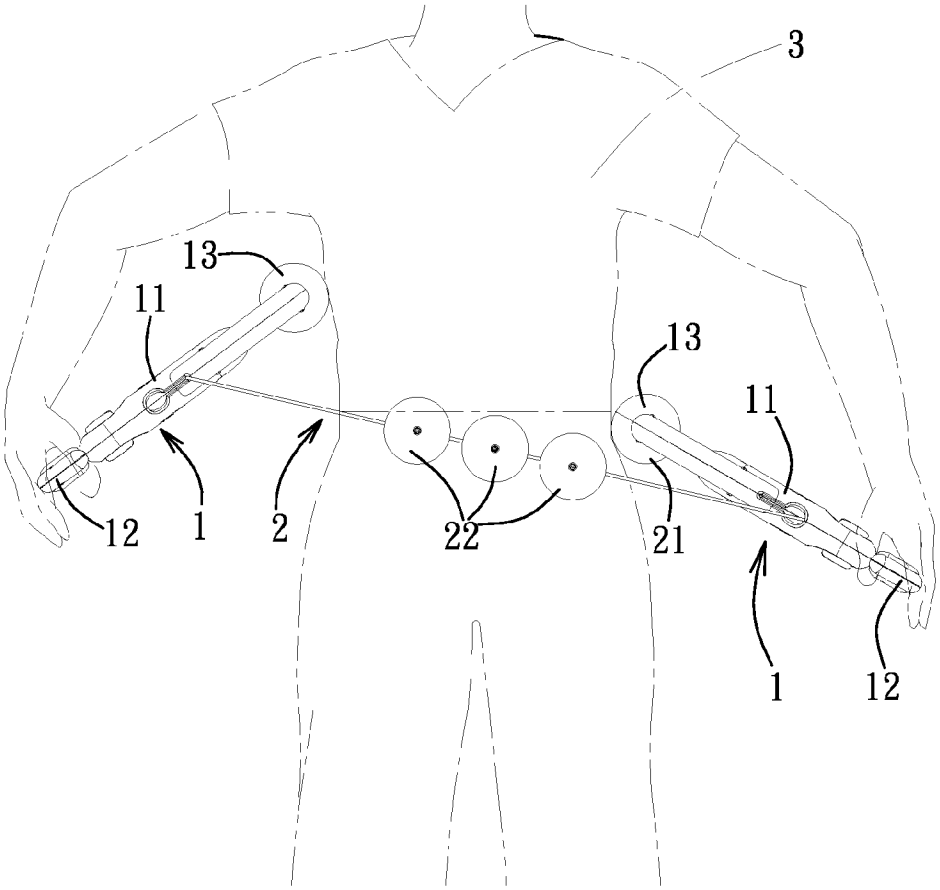
Figure 14:
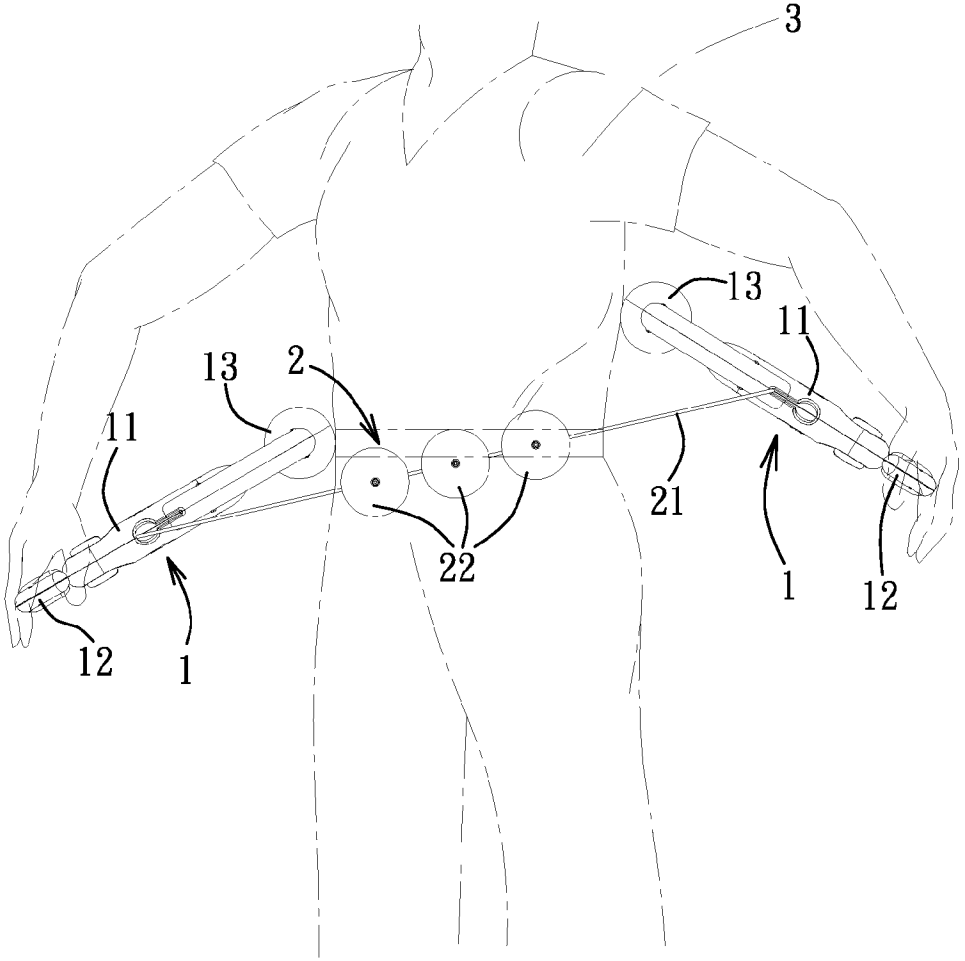
Figure 15:
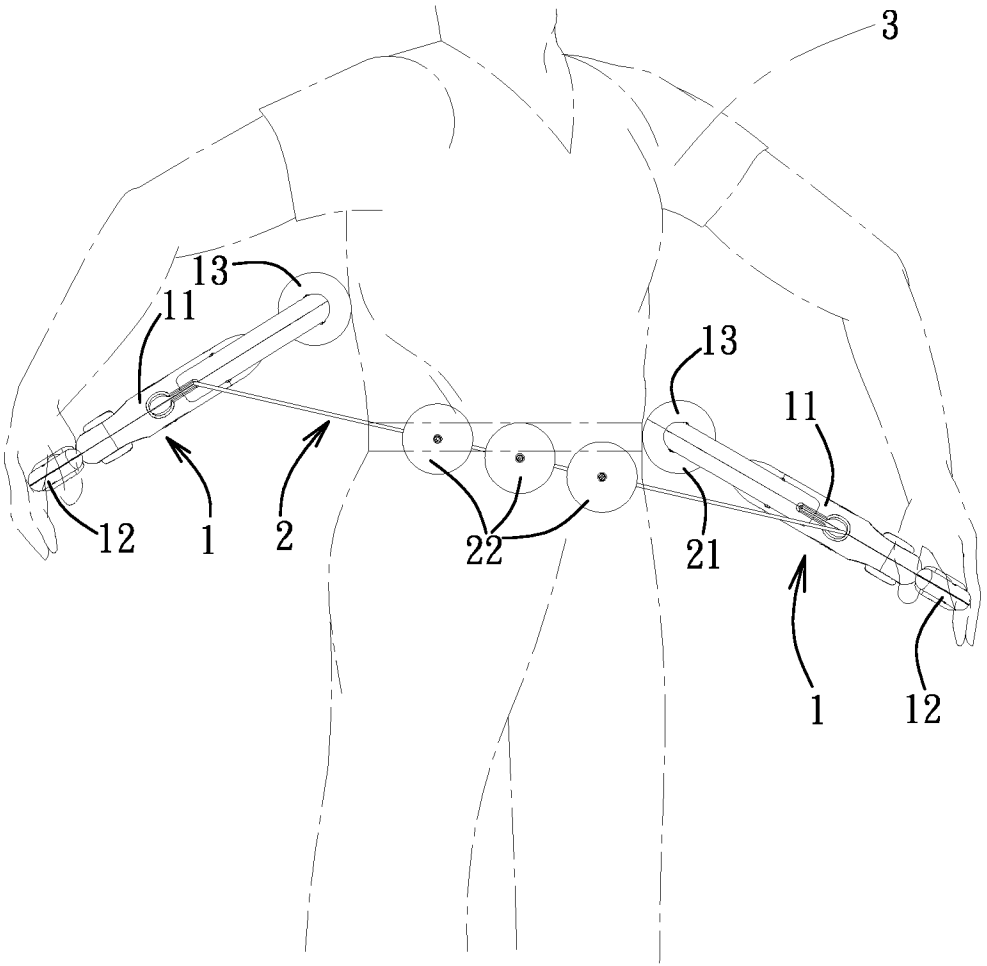

With particular reference to FIGS. 9 and 10, the grips 12 are held by the hands to move upwardly and downwardly, so as to roll the rolling units 13 on the waist and hip of the user and move the sliding units 22 upwardly and downwardly on the abdomen, back, or thigh of the user, in such a manner that the sliding units 22 are arranged horizontally. Referring to FIG. 11, the user 3 can operate only one of the grips 12 to move the corresponding rolling unit 13 upwardly and downwardly on the waist. Referring to FIGS. 12 and 13, the grips 12 can be held at different heights to move the sliding units 22 on the abdomen, back, or thigh of the user in such a manner that the sliding units 22 are arranged along an inclined direction. Referring to FIGS. 14 and 15, while the sliding units 22 are being moved upwardly and downwardly such that the sliding units 22 along the inclined direction, the waist of the user 3 is turned aside, so as to massage the muscles of the waist seldom exercised.

With particular reference to FIG. 3, when the user 3 desires to remove the abdominal exercise device therefrom, the rope body 212 of one of the elastic connecting pieces 21 is moved along the corresponding narrow opening portion 119, and is removed from the corresponding outer housing 11 through the corresponding wide opening portion 118. Hence, the assembly of the operating mechanisms 1 and the connecting mechanisms 2 is no longer a looped structure, thereby allowing for removal from the user 3.

With particular reference to FIGS. 4, 5, 6, and 9, since different users 3 may have different body shapes and sizes, preferably, the lengths of the operating mechanisms 1 can be changed. In this embodiment, through operation of the adjusting units 14, the lengths of the operating mechanisms 1 can be adjusted. During length adjustment of one of the operating mechanisms 1, the corresponding bolt 143 is first removed from the corresponding nut 144, and is disengaged from the through holes 116 of the corresponding outer housing 11 and the corresponding adjusting rod 141. Next, the corresponding adjusting rod 141 is moved within the corresponding insert groove 115 to a desired position. Upon arrival of the corresponding adjusting rod 141 at the desired position, the corresponding bolt 143 is inserted into the through holes 116 of the corresponding outer housing 11 and the corresponding positioning hole 142 in the corresponding adjusting rod 141, and is threaded into the threaded hole 148 of the corresponding nut 144 until the plate-shaped head 145 of the corresponding bolt 143 comes into contact with the corresponding second sidewall 113 and the plate-shaped main body 144A of the nut 144 comes into contact with the corresponding second sidewall 114. The position of the corresponding adjusting rod 141 relative to the corresponding outer housing 11 can be realized by observing the color of the colored ring 149 visible through the window 117.

In view of the above, by holding and moving the grips 12 with the hands, the rolling units 13 and the sliding units 22 can be pressed against and moved upwardly and downwardly on the abdomen, back, or thigh of the user 3, thereby providing exercising, massaging, and figure shaping effects. Thus, the object of this invention is achieved.

With this invention thus explained, it is apparent that numerous modifications and variations can be made without departing from the scope and spirit of this invention. It is therefore intended that this invention be limited only as indicated by the appended claims.

I claim:

1. An abdominal exercise device comprising:

two operating mechanisms, each of which includes an outer housing, a grip disposed at an end of said outer housing, and a rolling unit disposed at an opposite end of said outer housing, each of said outer housings of said operating mechanisms having two opposite first sidewalls, said grips of said operating mechanisms being adapted to be movable upwardly and downwardly relative to the body of a user; and two connecting mechanisms each connected between said operating mechanisms such that said connecting mechanisms cooperate with said operating mechanisms to form a looped structure, each of said connecting mechanisms including an elastic connecting piece extending from one of said first sidewalls of one of said outer housings into an adjacent one of said first sidewalls of the other of said outer housings, and a plurality of sliding units sleeved movably on said elastic connecting piece, said sliding units of said connecting mechanisms being movable together with said grips of said operating mechanisms.

2. The abdominal exercise device as claimed in claim 1, wherein each of said rolling units includes at least one pair of ball bearings, and at least one rolling piece sleeved on said ball bearings, the pair number of said ball bearings corresponding to the number of said rolling piece.

3. The abdominal exercise device as claimed in claim 2, wherein each of said rolling units includes two pairs of said ball bearings, and two said rolling pieces, and further includes a plurality of position-limiting pieces positioned such that each pair of said ball bearings can be confined between two adjacent ones of said position-limiting pieces for preventing movement of said ball bearings relative to a corresponding one of said outer housings.

4. The abdominal exercise device as claimed in claim 3, wherein each of said outer housings includes two hollow halves, each of said hollow halves including an elongated elliptical main body having said two opposite first sidewalls, and two channel bar portions extending respectively from said first sidewalls and each having an inclined section inclined relative to a longitudinal direction of said main body, and a transverse bar section perpendicular to the longitudinal direction of said main body and having an end connected to an end of said inclined section, said inclined sections of each of said hollow halves extending respectively from said two opposite first sidewalls of a corresponding one of said hollow halves away from each other, said transverse bar sections of each of said hollow halves extending respectively from said inclined sections of a corresponding one of said hollow halves toward each other, so as to confine a corresponding one of said rolling units therebetween, in such a manner that two corresponding ones of said position-limiting pieces are secured respectively within said transverse bar sections of a corresponding one of said hollow halves.

5. The abdominal exercise device as claimed in claim 2, wherein each of said rolling pieces includes a first half and a second half, each of which is formed with a plurality of tongues and a plurality of grooves, said tongues of said first half engaging respectively said grooves of said second half, said grooves of said first half engaging respectively said tongues of said second half.

6. The abdominal exercise device as claimed in claim 1, wherein each of said outer housings further has two opposite second sidewalls connected between said first sidewalls, an insert groove extending from said first end toward said second end, and two aligned through holes formed respectively through said second sidewalls, each of said operating mechanisms further including an adjustment unit, each of said adjustment units of said operating mechanisms including an adjusting rod inserted movably into said insert groove in a corresponding one of said outer housings and formed with a plurality of positioning holes arranged along a longitudinal direction of said adjusting rod, and a lock bolt unit extending through said through holes in said second sidewalls and a selected one of said positioning holes in said adjusting rod for locking said adjusting rod relative to the corresponding one of said outer housings, said adjusting rod of each of said adjustment units being connected fixedly to said grip of a corresponding one of said operating mechanisms.

7. The abdominal exercise device as claimed in claim 6, wherein said lock bolt unit of each of said adjustment units includes:

a bolt having a plate-shaped head abutting against one of said second sidewalls of a corresponding one of said outer housings, and a stem extending from said head and having an externally threaded end, and a nut having a plate-shaped main body abutting against the other of said second sidewalls of the corresponding one of said outer housings, and a threaded hole formed in said plate-shaped main body and engaging said externally threaded end of said bolt.

8. The abdominal exercise device as claimed in claim 6, wherein each of said adjustment units further includes a plurality of colored rings sleeved on said adjusting rod, any two adjacent ones of said colored rings abutting against each other, at least one of said second sidewalls of each of said outer housings being formed with a window, through which one of said colored rings is visible.

9. The abdominal exercise device as claimed in claim 1, wherein each of said elastic connecting pieces has two enlarged ends and a rope body connected between said enlarged ends and permitting said sliding units to be sleeved thereon, each of said first sidewalls of said outer housings being formed with an opening having a wide opening portion sized so as to allow a corresponding one of said enlarged ends of said elastic connecting pieces to move therethrough, and a narrow opening portion connected to said wide opening portion and sized so as to prevent movement of the corresponding one of said enlarged ends of said elastic connecting pieces therethrough, while allowing for extension of said rope body of a corresponding one of said elastic connecting pieces therethrough.

10. The abdominal exercise device as claimed in claim 1, wherein each of said sliding units includes a hollow first half and a hollow second half, each of which is formed with a plurality of tongues and a plurality of grooves, said tongues of said first half engaging respectively said grooves of said second half, said grooves of said first half engaging respectively said tongues of said second half.

11. The abdominal exercise device as claimed in claim 10, wherein each of said sliding units further includes a central rod connected between centers of said first and second halves, and two apertures formed in an assembly of said first and second halves and aligned with said central rod, each of said elastic connecting pieces having two enlarged ends and a rope body connected between said enlarged ends and permitting said sliding units to be sleeved thereon, said rope body of each of said elastic connecting pieces extending through said apertures in a corresponding one of said sliding units and around said central rod of the corresponding one of said sliding units.

* * * * *